US007124614B2

(12) United States Patent
Cronholm et al.

(10) Patent No.: US 7,124,614 B2
(45) Date of Patent: Oct. 24, 2006

(54) METHOD AND A DEVICE FOR REDUCING THE NOISE LEVEL AT A DEEP-DRAWING PRESS

(75) Inventors: Markus Cronholm, Linkoping (SE); Jacob Axelsson, Linkoping (SE)

(73) Assignee: Stromsholmen AB, Tranas (SE)

( * ) Notice: Subject to any disclaimer, the term of this patent is extended or adjusted under 35 U.S.C. 154(b) by 254 days.

(21) Appl. No.: 10/479,143

(22) PCT Filed: May 31, 2002

(86) PCT No.: PCT/SE02/01046

§ 371 (c)(1),
(2), (4) Date: Nov. 25, 2003

(87) PCT Pub. No.: WO02/096580

PCT Pub. Date: Dec. 5, 2002

(65) Prior Publication Data

US 2004/0250595 A1 Dec. 16, 2004

(30) Foreign Application Priority Data

May 31, 2001 (SE) ..... 0101928

(51) Int. Cl.
*B21D 22/00* (2006.01)

(52) U.S. Cl. ..... 72/350; 72/453.13

(58) Field of Classification Search ..... 72/350, 72/351

See application file for complete search history.

(56) References Cited

U.S. PATENT DOCUMENTS 6,016,680 A * 1/2000 Matsuoka ..... 72/350
6,059,273 A 5/2000 Sand et al.

FOREIGN PATENT DOCUMENTS

| | | |
|---|---|---|
| DE | 36 23 188 | 7/1986 |
| DE | 3623188 C1 * | 9/1987 |
| EP | 0 956 913 A1 | 11/1999 |
| EP | 1 034 858 | 9/2000 |
| EP | 1 113 185 B1 | 11/2004 |

* cited by examiner

*Primary Examiner*—Derris H. Banks
*Assistant Examiner*—Debra Wolfe
(74) *Attorney, Agent, or Firm*—Merchant & Gould P.C.

(57) ABSTRACT

The invention relates to a method and an arrangement in a press tool for reducing the relative speed at which a moveable sheet metal holder impacts against a press upper part for transmitting a working force or is separated therefrom on completion of pressing. The invention is characterised in that the force for acceleration of the sheet metal holder is transmitted from the press upper part by way of a mechanical transmission device fitted to the sheet metal holder in such a way that an initial movement is imparted to the holder before the press upper part comes to bear against the sheet metal fabrication and sheet metal holder, and that only then does the press upper part impact against sheet metal fabrication and sheet metal holder and for depression of gas-filled springs arranged adjacent to and supporting the sheet metal holder.

5 Claims, 8 Drawing Sheets

Speed of the holder

METHOD AND A DEVICE FOR REDUCING THE NOISE LEVEL AT A DEEP-DRAWING PRESS

The present invention relates to an arrangement according to the pre-characterising clause of claim 1 and use of an arrangement according to the invention as specified in the pre-characterising clause of claim 5.

BACKGROUND

The use of a tool and fabrication holder mounted in a press is known in sheet metal forming operations. Certain parts of the tool follow the movement of the press slide, while other parts are at rest during a part of the press cycle. One example is where a sheet metal holder is used, which rests on springs, which exert the sheet metal holding force. Other examples of moveable tool parts are shuttles and punches. The springs, at least three in number, are at rest until the upper tool part impacts against the holder and moves this downwards, the springs being tensioned. A direct impact on a stationary sheet metal holder places heavy stresses on the tool and on mechanical parts of the press, whilst unwanted noise and vibrations are generated. An excessive impact between the upper tool part and the sheet metal holder also has a negative effect on the sheet metal forming process itself, since the sheet metal fabrication that is to be formed is situated between upper tool and sheet metal holder, and since there is a risk of the sheet metal lubrication film breaking down, which carries a risk of irregular quality in the subsequent sheet metal drawing process.

After the pressing process, the holder with finish-formed sheet metal part is brought into its original position by the springs returning to their extended standby position. Because a certain return speed is imparted to the holder by the springs, there is a risk that the holder will not stop immediately when the springs reach their limit position, but will continue until the g-force has braked the speed. There is a risk here that both holder and fabrication will lift off entirely from the springs. This "lifting" of the fabrication and the holder causes wear and creates noise. There is also a risk of the holder itself jumping out of its guides.

Attempts have previously been made to solve the aforementioned problem by the use of CNC hydraulic systems or by reducing the impact stresses and the fabrication and holder lifting through the use of separate dampers. The disadvantage of CNC hydraulic systems is the need for a separate hydraulic source and cooling facility for the hydraulic fluid used. Connecting hoses are required. Energy losses occur during acceleration and retardation. Moreover, such a system is relatively complicated and expensive. Damping the impact through the use of separate dampers likewise has disadvantages, partly due to the generation of heat and partly due to the fact that the damping function does not vary according to the pressing speed. Known damping arrangements are often temperature-sensitive and also sensitive to mechanical effects.

A design construction for initiating an downward movement of a fabrication holder is specified in EP 1 034 858 A2. This design construction requires special arrangements for incorporation into a pressing tool and it is doubtful whether the design construction can be retrofitted to existing tools.

As an example of the prior art, reference will also be made to DE 3623188 C1, on the basis of which the pre-characterising clauses of each of the independent claims have been worded.

SUMMARY OF THE INVENTION

The object of the present invention is to provide an arrangement of the type referred to in the introductory part, by means of which the aforementioned disadvantages in respect of the noise generated and the wear to the pressing tool are at least reduced. The invention furthermore adjusts the movement between holder and upper tool part without any significant energy losses occurring and whilst at the same time ensuring a correct working process for the sheet metal fabrication. In addition, the method and the arrangement according to the invention permit an increase in the working speed without an increased risk of the holder and the sheet metal fabrication coming loose from one another.

The invention is easily applicable and can be fitted to the holder of existing working tools, that is to say in the tool part that is to be accelerated and retarded, and which can easily be removed for maintenance without the need to dismantle any other tool components, and which, moreover, takes up little space and requires a minimum of maintenance.

The invention furthermore provides a mechanical linkage device, in which a built-in gas-filled spring is capable of accumulating a proportion of the kinetic energy of the press slide during a controlled acceleration of the holder with sheet metal fabrication prior to the actual working process. The gas-filled spring then releases this energy in order to return the mechanical linkage device and the holder before the next sheet metal working process, the kinetic energy being restored to the press slide.

The invention provides an arrangement in which the mechanical linkage device is so arranged that the acceleration of the holder with sheet metal fabrication occurs primarily before the gas-filled springs, supporting the holder and returning the sheet metal fabrication, start to be compressed during the working stage. This naturally reduces the load on the arrangement according to the invention.

The invention therefore achieves control over the movement of the holder, this control being directly linked to the position of the press upper part, which means that a parallel movement is imparted to the holder irrespective of the load thereon.

The invention will now be explained in more detail with reference to an application in a press shown in the drawings attached. The person skilled in the art will appreciate that the invention, as already stated in the introductory part, can also be adapted to other sheet metal working tools, in connection with punching or cutting, for example, so that the following description must only be regarded as an example of the applicability of the invention.

BRIEF DESCRIPTION OF THE DRAWINGS

In FIG. 1, A denotes a moveable upper tool part, B a holder part supported by gas-filled springs D, and E four movement controlling linkage devices according to the invention fitted to a holder.

DETAILED DESCRIPTION

Figure 1:
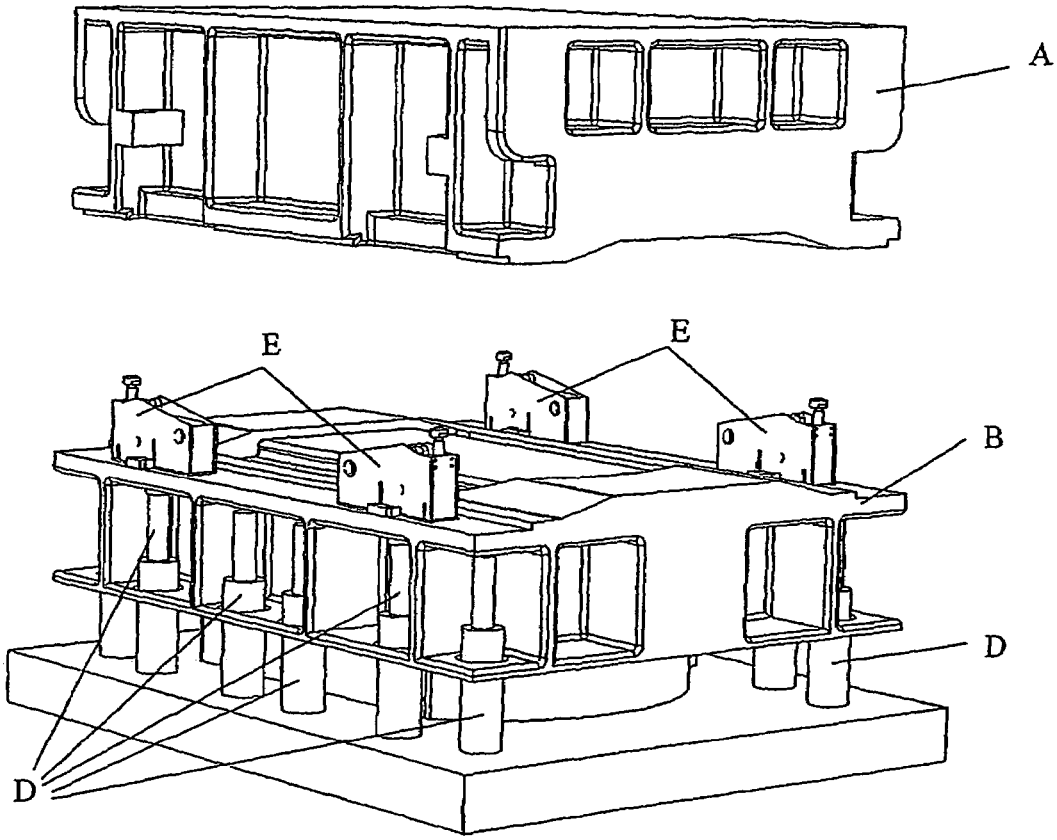
FIG. 1 shows a diagrammatic perspective view of a moveable press upper part, a sheet-metal fabrication holder supported by gas-filled springs and four movement-controlling linkage devices according to the invention located directly on the holder and shown in a standby position for pre-acceleration of the sheet metal holder.

An embodiment and the function of the arrangement according to the invention denoted by E will now be explained with reference to FIGS. 2*a* to 2*c*. A housing 20, connected to the holder part B, contains a generally angled linkage arm 5, which is capable of rotating about an axis 6, one (short) leg 5*a* of which engages by way of a roller 8 with a piston rod 7*a* of a gas-filled spring 7, and the other (longer) leg 5*b* of which is connected by way of a link 10 to the one leg 3*b* of a linkage arm 3, which is rotatable about an axis 4 and is operatively connected by way of a roller 3*a* and a stop 1*a* to an upper push rod 1 displaceably supported in the housing 20. A lower push rod 2, likewise displaceably supported in the housing 20, is substantially parallel with the push rod 1 and operatively engages by way of a roller 9 with the linkage arm 5*b* of the linkage arm 5.

The lower push rod 2 is designed to be acted upon by springs of the holder part B and its displacement distance corresponds to a distance over which the holder part B must be brought from its basic position at largely the same speed as the upper tool part A has at the start of a deep-drawing operation or other sheet metal working operation.

The upper push rod 1 is designed to be acted upon by the upper tool part A and its function, under the said action, is to produce an adjustment of the linkage arms 3 and 5 in such a way that the action of the upper tool part A on the holder part B imparts an acceleration to the latter, which is largely constant from the basic position until the start of the deep-drawing operation, which means that at the latter instant/position the upper tool part A and the holder part B have largely the same speed.

Figure 2A:
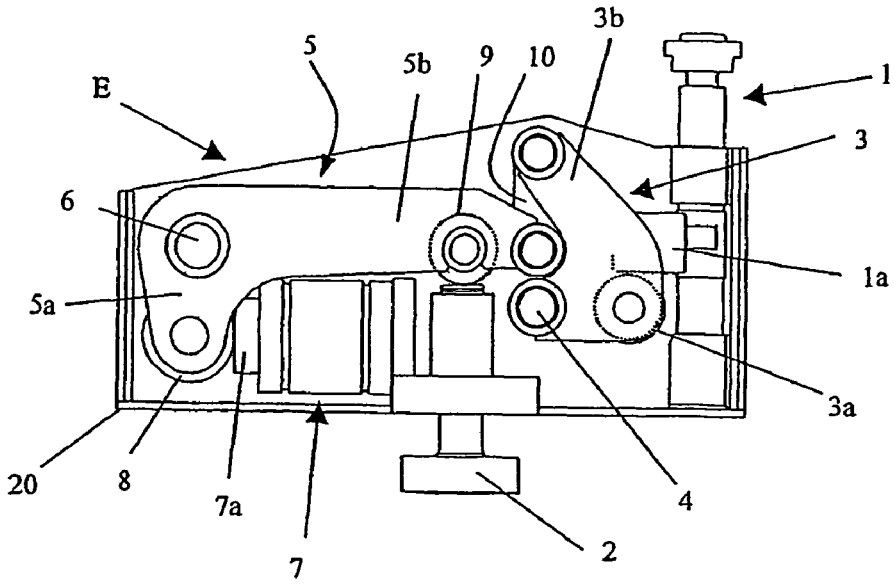
FIGS. 2*a* to 2*c* show successive activation positions of the movement-controlling linkage device in the acceleration of sheet metal holder and sheet metal fabrication.
Figure 2B:
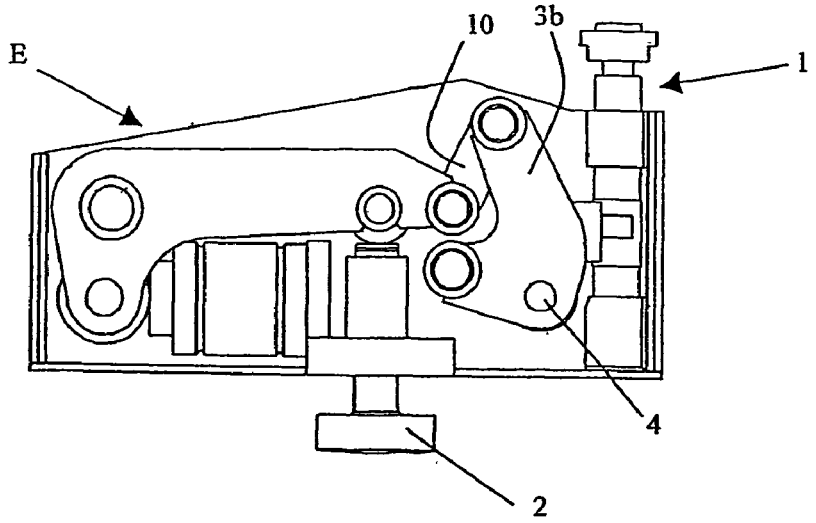
Figure 2C:
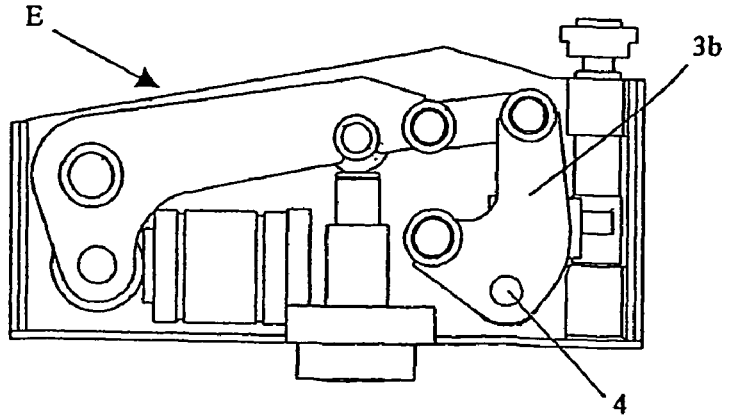

It will be seen from FIGS. 2*a* to 2*c* how the linkage arms 3 and 5 are rotated in relation to one another in such a way that they assume the function of a single lever arm, the leg lengths of which may be varied so that a ratio is obtained, which gives the holder part fixed to the linkage device E the desired final speed corresponding to the speed of the tool part A.

Figure 3A:
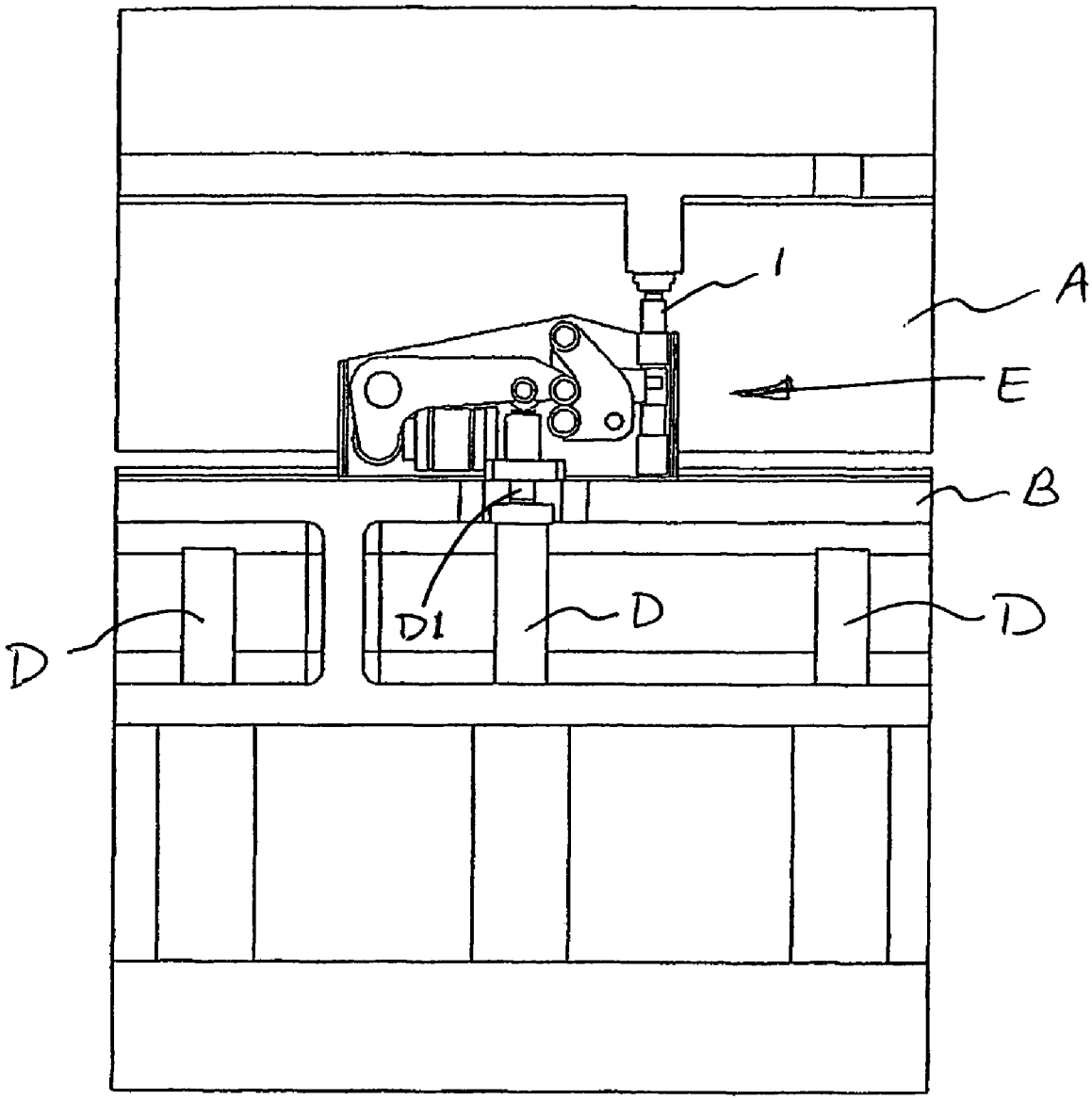
FIGS. 3*a* to 3 show different positions of the pres upper part, sheet metal holder and gas-filled springs in a pressing process according to the linkage device positions show in FIGS. 2*a* to 2*c*.

FIG. 3*a* shows the said basic position, in which the press upper part A is situated a distance above the holder part B. When the upper push rod 1 of the linkage device E comes to bear against the descending press upper part A, an acceleration of the holder part B commences, so that this has a speed approximately equal to the speed of the press upper part A, when the full force of the press upper part A acts on the holder B. See also the movement of the press upper part A and the holder B together with piston rods D1 of the gas-filled springs D from the position shown in FIGS. 3*c* to 3. Returning to FIG. 2*a,* this therefore shows the basic position, in which the support 2 is rigid or locked to the linkage mechanism 5. Only when the upper push rod 1 has reached the position shown in FIG. 2*b,* which occurs due to the fact that a stop 1*a* on the push rod 1 acts on the roller 3*a* on the linkage mechanism 3, which is articulated to the joint 4. Continued depression of the push rod 1 is partially damped by the gas-filled spring 7 through movement of the linkage mechanism 5, which is rotated about the axis 6 and presses in the piston of the gas-filled spring by way of the roller 8. The support part 2 is all the time in contact, via the roller device 9, with the second linkage part 5 in close proximity to the said one end of the linkage part 5, in order to ensure that the movement of the holder B is linked to the speed of the press upper part A. FIG. 2*c* shows the "final position" of the linkage device E in the depression of the holder B, that is to say a position in which the linkage device E is rigid. The linkage device has here therefore completed its holder acceleration function and is now ready, on completion of the working operation, to brake the upward movement of the holder in the limit position of the gas-filled spring pistons entirely mechanically, in such a way that the linkage device functions inversely and gives a very slow outward movement of the support 2 on completion of the return movement and is thereby capable of maintaining a constant contact with the holder B. The primary function of the gas-filled spring 7 is to return the linkage mechanisms of the linkage device E to the basic position shown in FIG. 3*a*.

Figure 3B:
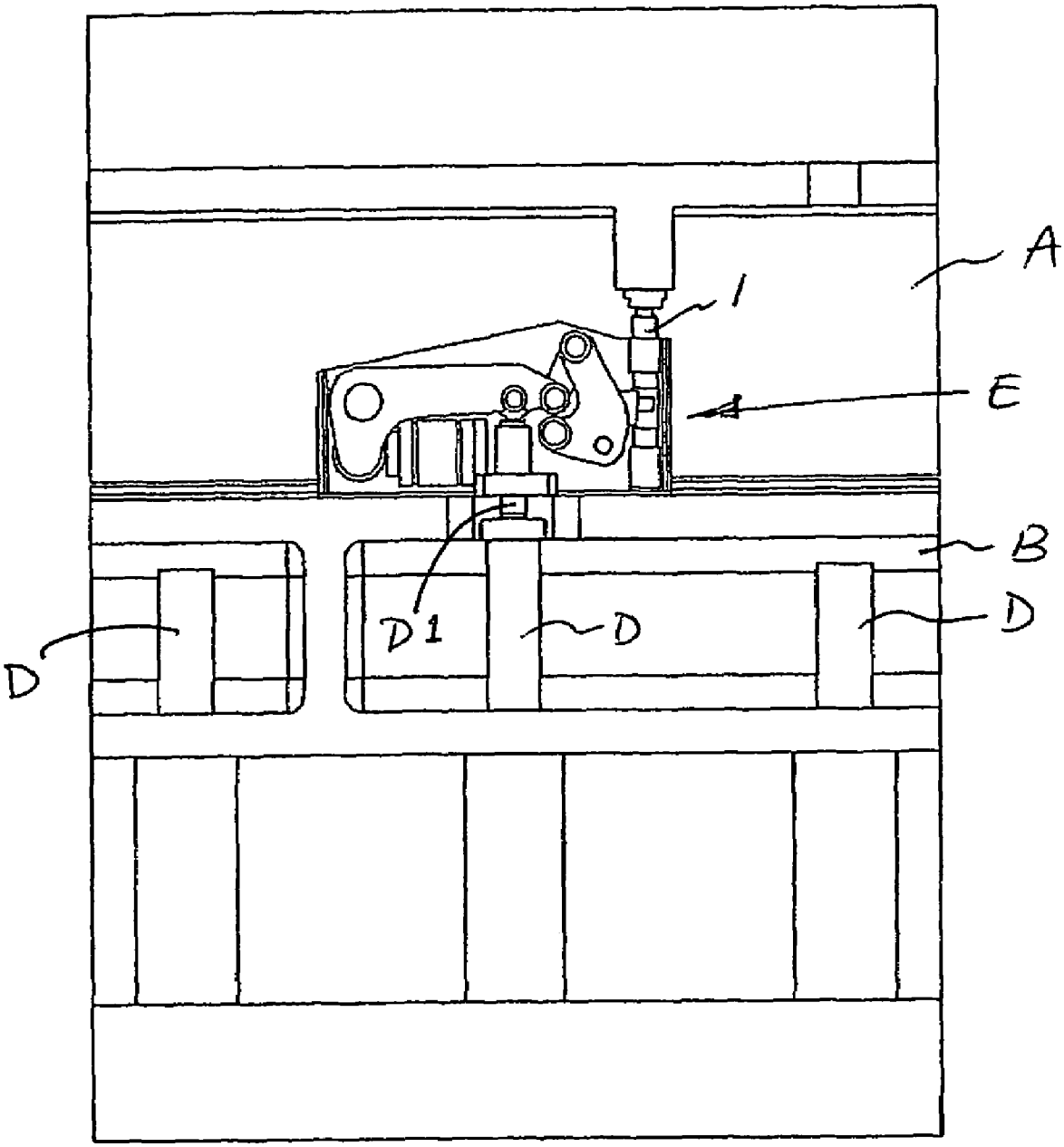
Figure 3C:
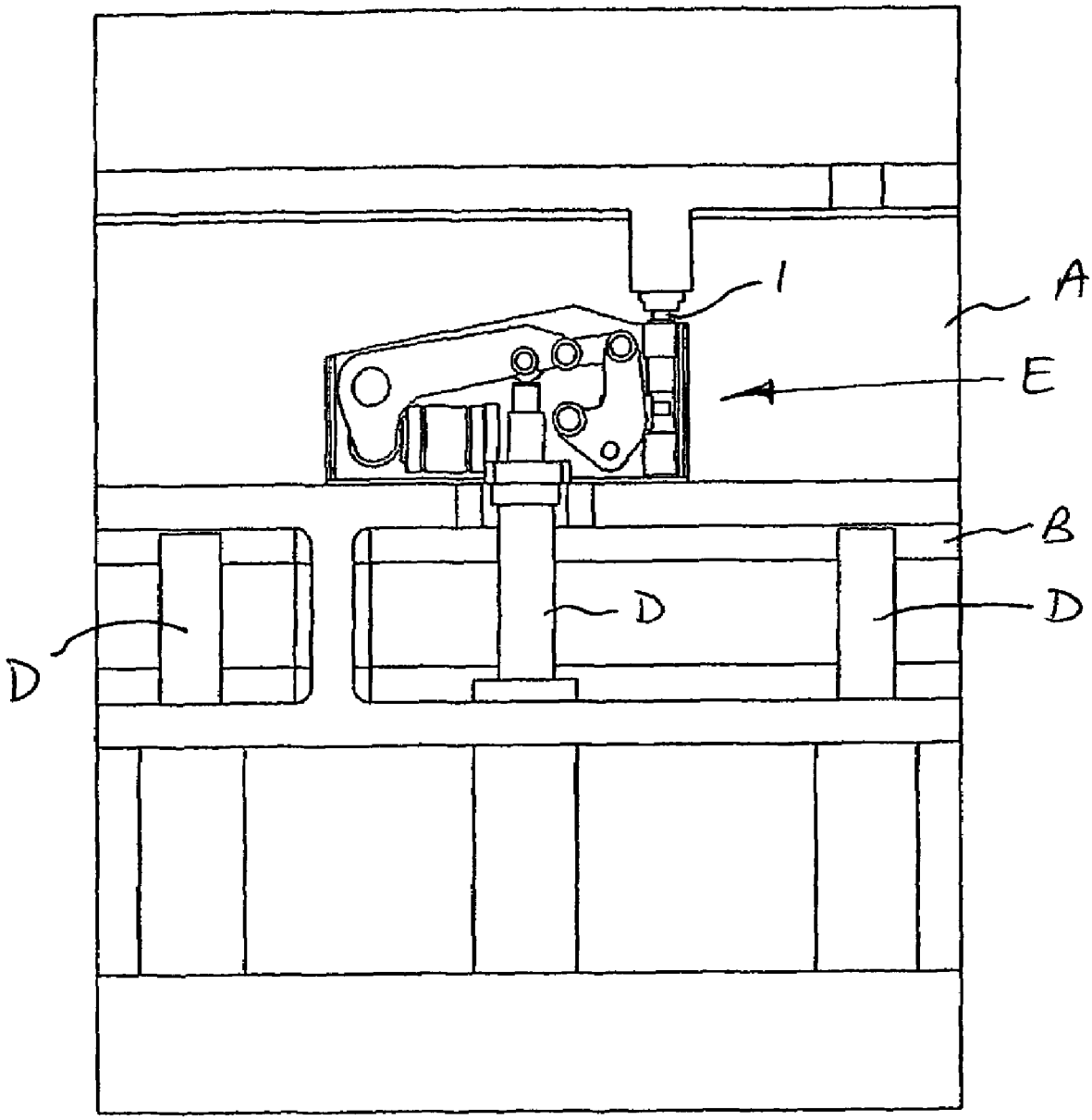

FIGS. 3*a* to 3*c* show positions largely corresponding to the positions of the linkage device E, press upper part A and holder B during the pressing process, as shown in FIGS. 2*a* to 2*c*.

Figure 4A:
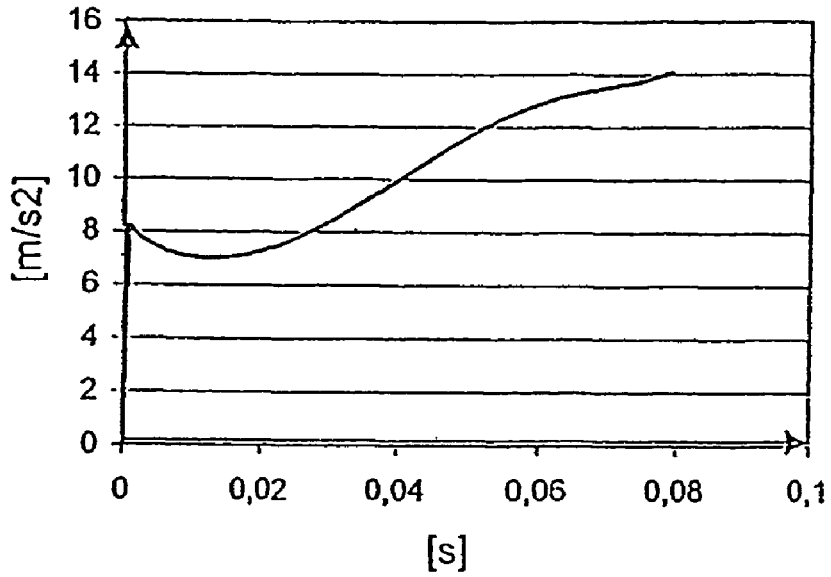
FIGS. 4*a* and 4*b* are diagrams respectively showing the acceleration and speed of the holder as a function of the time.
Figure 4B:
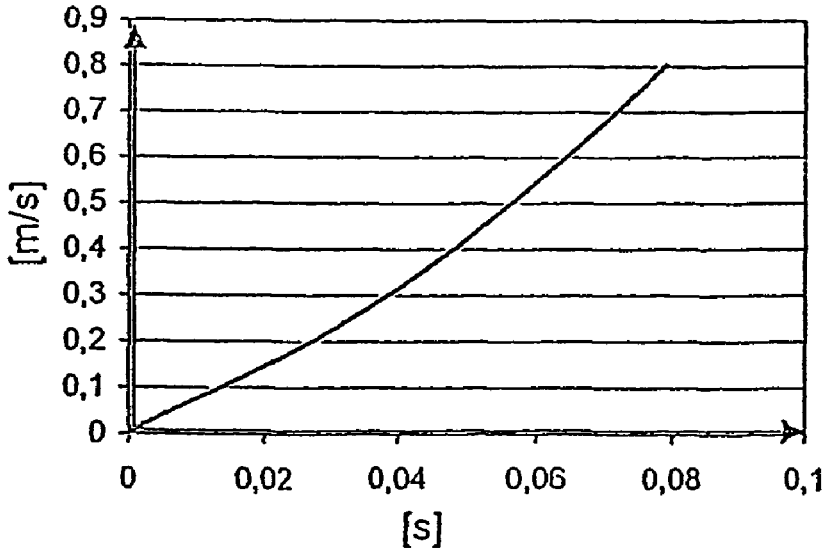

FIGS. 4*a* and 4*b* respectively show diagrams of the acceleration and speed of the holder. Through a suitable choice of the linkage mechanisms 3 and 5 (in FIG. 2*a*), that is to say the lengths of the lever arms and mutual points of articulation, the holder acceleration can be designed so as to achieve the earlier speed matching with the upper press part A.

Figure 5A:
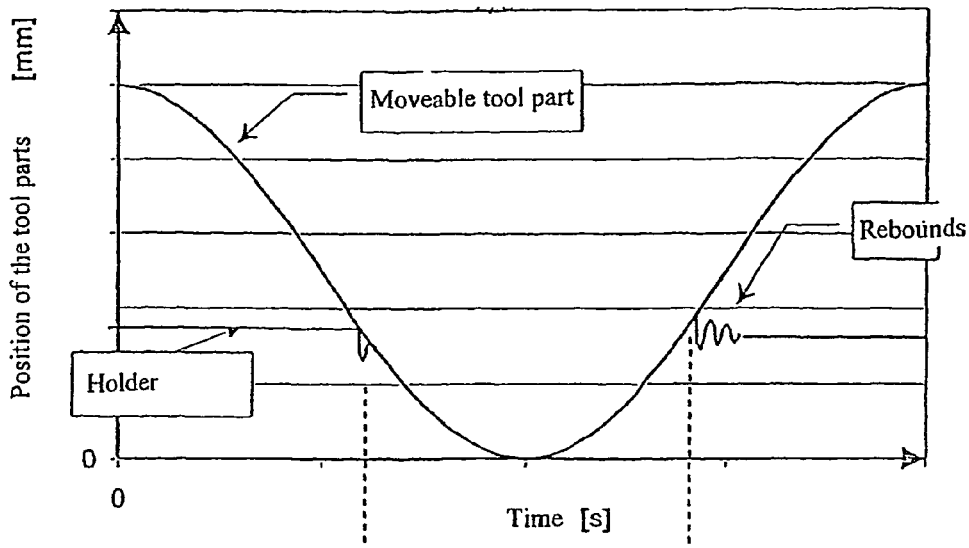
FIGS. 5*a*–5*b* are schematic diagrams respectively showing the movement of the press parts and the force exerted on the sheet metal holder without any use of any movement-controlling arrangement.
Figure 5B:
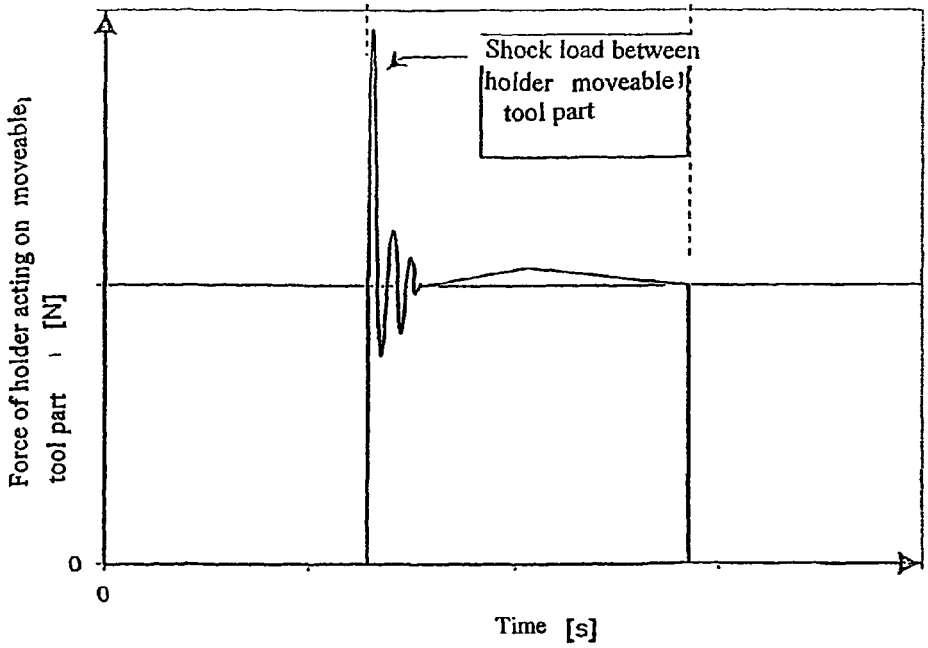
Figure 6A:
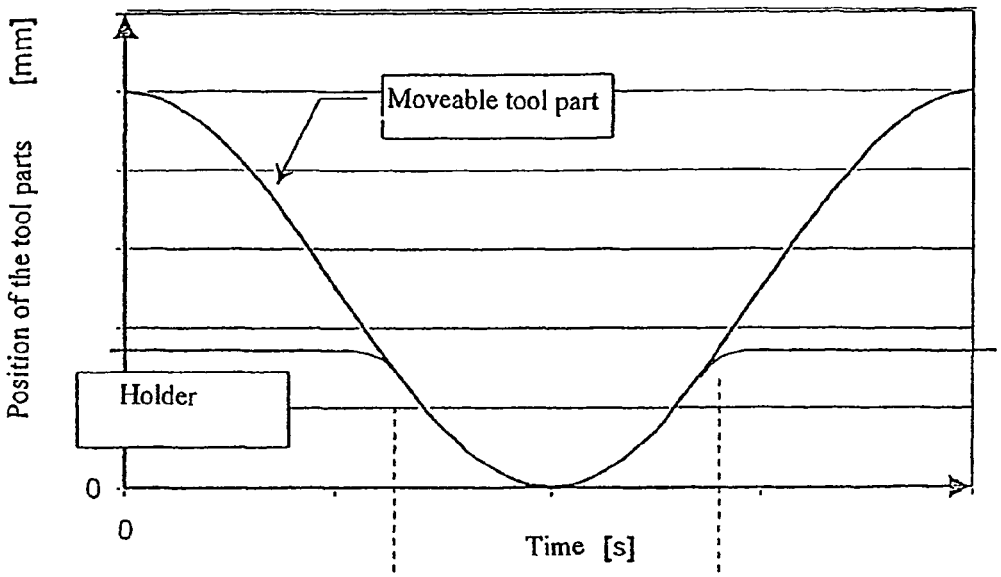
FIGS. 6*a*–6*b* are schematic diagrams corresponding to FIGS. 5*a*–5*b* respectively showing the movement of the press upper part and the holder, and the force exerted on the sheet metal holder, using a movement control according to the present invention.
Figure 6B:
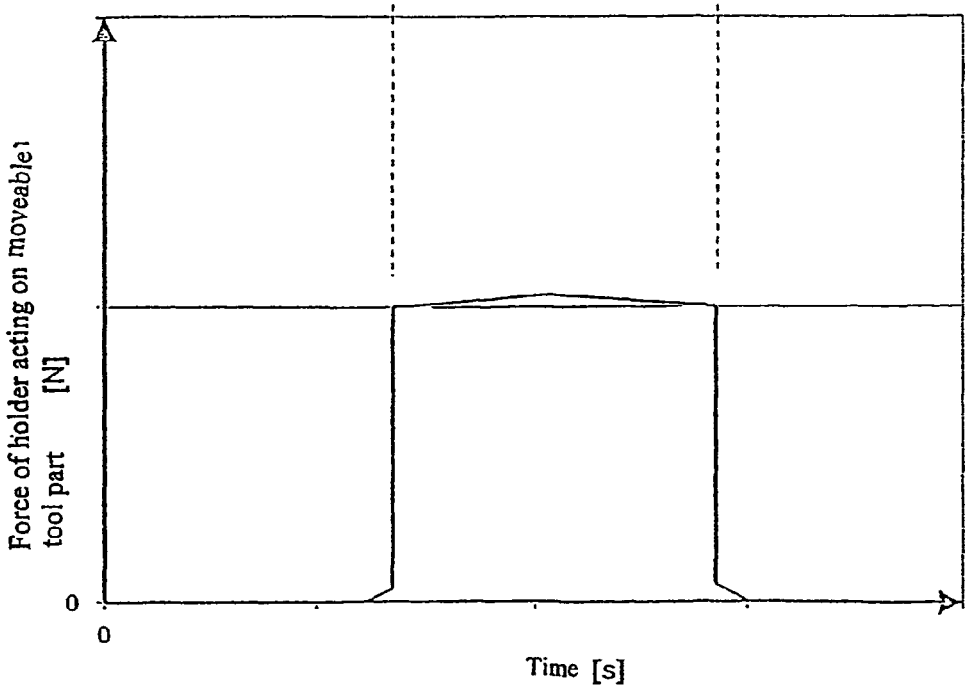

FIGS. 5*a* and 5*b* respectively show diagrams of the movement of the press upper part and the force exerted on the plate holder without the use of a movement-controlling arrangement according to the invention. FIG. 5*a* clearly shows that a heavy impact loading occurs when the press upper part encounters the holder, just as lifting of the holder occurs at the end of the press cycle. FIGS. 6*a* and 6*b* show how the impact loading is however at least reduced by the use of a method/arrangement according to the invention.

The invention is not limited to the example of an embodiment described above but lends itself to modifications within the scope of the claims specified below.

The invention claimed is:

1. Arrangement in a sheet metal working tool comprising an upper moveable tool part, a lower tool part and a holder part designed, during a sheet metal working operation in which a sheet metal fabrication is subjected to working between the tool parts, to hold the sheet metal fast to the moveable tool half in a working position by means of spring elements supporting the holder, and comprising members designed, in a movement from a predetermined basic position at a distance from the working position, to impart a speed component to the holder part, wherein the said member comprises a system of interconnected and articulated links wherein each link comprises at least one leg, connected to the holder part, of which a first link is designed to be acted upon by the movement of the upper tool half, so that due to the articulated connection between the links a power-transmitting operative connection is produced between the upper tool half and the holder part, the power-transmitting operative connection operating as a single linkage arm, the length of at least one leg of which being variable over time so that after completing the movement from the basic resting position to the starting position of a working operation the holder part has substantially the same speed as the moveable tool part and a corresponding retardation in the subsequent ascending movement, and said member further having a push rod actuatable by the tool upper part, a stop on the push rod being designed to act on a roller device arranged in the first link, which is articulated about a first joint in said member, the first link being connected to one end of a second link of the interconnected and articulated links, which is articulated about a second joint and the other end of which interacts with a piston rod of a spring mechanism, a support part, by way of a roller device, engaging throughout with the second link closely adjacent to the said one end of the second link.

2. Arrangement according to claim 1, wherein the said member is fixed solely to the holder.

3. Arrangement according to claim 1, wherein the said member is designed to be acted upon by the moveable tool part over a moving distance between the basic position and the starting position for the working operation, over which distance the supporting spring hydraulic or spring elements are resting.

4. Arrangement according claim 1, wherein the said member comprises an energy-storing element, which is designed to store mechanical energy during movement of the holder part from the basic position to the working position, and is designed thereafter to release the store energy, thereby reversing the movement of the holder part from the working position to the said basic position.

5. Arrangement for use in a sheet metal working tool for reducing a relatively high speed, at which a moveable sheet metal holder impacts against a tool upper part for transmitting a working force or is separating therefrom on completion of working, comprising a linkage mechanism, wherein the linkage mechanism comprises a mechanical transmission device arranged in the sheet metal holder and having a push rod actuatable by the tool upper part, a stop on the push rod being designed to act on a roller device arranged in a first linkage part, which is articulated about a first joint in the transmission device, the linkage part being connected to one end of a second linkage part, which is articulated about a second joint and the other end of which interacts with a piston rod of a spring mechanism, a support part, by way of a roller device, engaging throughout with the second linkage part closely adjacent to the said one end of the second linkage part.

* * * * *